US006693607B1

(12) United States Patent
Lee et al.

(10) Patent No.: US 6,693,607 B1
(45) Date of Patent: Feb. 17, 2004

(54) METHOD FOR DRIVING PLASMA DISPLAY PANEL WITH DISPLAY DISCHARGE PULSES HAVING DIFFERENT POWER LEVELS

(75) Inventors: Seong-charn Lee, Seoul (KR); Jeong-duk Ryeom, Chungcheongnam-do (KR); Kyoung-ho Kang, Chungcheongnam-do (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 503 days.

(21) Appl. No.: 09/692,178

(22) Filed: Oct. 20, 2000

(30) Foreign Application Priority Data

Nov. 11, 1999 (KR) ..... 99-49943

(51) Int. Cl.[7] ..... G09G 3/28
(52) U.S. Cl. ..... 345/60; 345/67
(58) Field of Search ..... 345/60–72; 315/169.1, 315/169.4

(56) References Cited

U.S. PATENT DOCUMENTS 5,952,986 A * 9/1999 Nguyen et al. ..... 345/68
6,271,811 B1 * 8/2001 Shimizu et al. ..... 345/68
6,292,159 B1 * 9/2001 Someya et al. ..... 345/60
6,342,874 B1 * 1/2002 Tokunaga et al. ..... 345/68
6,369,781 B2 * 4/2002 Hashimoto et al. ..... 345/60

* cited by examiner

*Primary Examiner*—Amr Awad
(74) *Attorney, Agent, or Firm*—Leydig, Voit & Mayer, Ltd.

(57) ABSTRACT

A method for driving a plasma display panel having front and rear substrates opposed to and facing each other, X and Y electrode lines between the front and rear substrates and parallel to each other and address electrode lines orthogonal to the X and Y electrode lines, to define corresponding pixels at intersections. In the driving method, a scan pulse is applied to the respective Y electrode lines with a time difference and the corresponding display data signals are simultaneously applied to the respective address electrode lines to form wall charges at pixels where a display discharge is to occur. Pulses for a display discharge are alternately applied to the X and Y electrode lines to cause a display discharge at the pixels where the wall charges have been formed. Also, the pulses for display discharges simultaneously applied to the X electrode lines start after the pulses for display discharges simultaneously applied to the Y electrode lines terminate, and the scan pulses and the corresponding display data signals are applied after the pulses for display discharges simultaneously applied to the X electrode lines terminate and before the pulses for display discharges simultaneously applied to the Y electrode lines start. The power levels of pulses for display discharges simultaneously applied to the Y electrode lines are greater than the power levels of pulses for display discharges simultaneously applied to the X electrode lines.

3 Claims, 7 Drawing Sheets

METHOD FOR DRIVING PLASMA DISPLAY PANEL WITH DISPLAY DISCHARGE PULSES HAVING DIFFERENT POWER LEVELS

BACKGROUND OF THE INVENTION

1. Field of the Invention

The present invention relates to a method for driving a plasma display panel, and more particularly, to a method for driving a three-electrode surface-discharge plasma display panel.

2. Description of the Related Art

FIG. 1 shows a structure of a general three-electrode surface-discharge plasma display panel, FIG. 2 shows an electrode line pattern of the panel shown in FIG. 1, and FIG. 3 shows an example of a pixel of the panel shown in FIG. 1. Referring to the drawings, address electrode lines $A_1$, $A_2$, . . . $A_m$, dielectric layers 11 and 15, Y electrode lines $Y_1$, $Y_2$, . . . $Y_n$, X electrode lines $X_1$, $X_2$, . . . $X_n$, phosphors 16, partition walls 17 and a MgO protective film 12 are provided between front and rear glass substrates 10 and 13 of a general surface-discharge plasma display panel 1.

The address electrode lines $A_1$, $A_2$, . . . $A_m$ are provided on the front surface of the rear glass substrate 13 in a predetermined pattern. The lower dielectric layer 15 covers the entire front surface of the address electrode lines $A_1$, $A_2$, . . . $A_m$. The partition walls 17 are located on the front surface of the lower dielectric layer 15 parallel to the address electrode lines $A_1$, $A_2$, . . . $A_m$. The partition walls 17 define discharge areas of the respective pixels and prevent optical crosstalk among pixels. The phosphors coatings 16 are located between partition walls 17.

The X electrode lines $X_1$, $X_2$, . . . $X_n$ and the Y electrode lines $Y_1$, $Y_2$, . . . $Y_n$ are arranged on the rear surface of the front glass substrate 10 orthogonal to the address electrode lines $A_1$, $A_2$, . . . $A_m$, in a predetermined pattern. The respective intersections define corresponding pixels. The X electrode lines $X_1$, $X_2$, . . . $X_n$ and the Y electrode lines $Y_1$, $Y_2$, . . . $Y_n$ are each comprised of transparent, conductive indium tin oxide (ITO) electrode lines ($X_{na}$ and $Y_{na}$ of FIG. 3) and metal bus electrode lines ($X_{nb}$ and $Y_{nb}$ of FIG. 3). The upper dielectric layer 11 entirely coats the rear surface of the X electrode lines $X_1$, $X_2$, . . . $X_n$ and the Y electrode lines $Y_1$, $Y_2$, . . . $Y_n$. The MgO protective film 12 for protecting the panel 1 against strong electrical fields entirely coats the rear surface of the upper dielectric layer 11. A gas for forming plasma is hermetically sealed in a discharge space 14.

The above-described plasma display panel is basically driven such that a reset step, an address step and a sustain-discharge step are sequentially performed in a unit subfield. In the reset step, wall charges remaining from the previous subfield are erased and space charges are evenly formed. In the address step, the wall charges are formed in a selected pixel area. Also, in the discharge display step, light is produced at the pixel at which the wall charges are formed in the address step. In other words, if alternating pulses of a relatively high voltage are applied between the X electrode lines $X_1$, $X_2$, . . . $X_n$ and the Y electrode lines $Y_1$, $Y_2$, . . . $Y_n$ a surface discharge occurs at the pixels at which the wall charges are formed. Here, a plasma is formed in the gas in the discharge space 14 and phosphors 16 are excited by ultraviolet rays and emit light.

FIG. 4 shows the structure of a unit display period based on a driving method of a conventional plasma display panel.

Here, a unit display period represents a frame in the case of a progressive scanning method, and a field in the case of an interlaced scanning method. The driving method shown in FIG. 4 is generally referred to as a multiple address overlapping display driving method. According to this driving method, pulses for a display discharge are consistently applied to all X electrode lines ($X_1$, $X_2$, . . . $X_n$ of FIG. 1) and all Y electrode lines ($Y_1$, $Y_2$, . . . $Y_{480}$) and pulses for resetting or addressing are applied between the respective pulses for a display discharge. In other words, the reset and address steps are sequentially performed with respect to individual Y electrode lines or groups, within a unit subfield, and then the display discharge step is performed for the remaining time period. Thus, compared to an address-display separation driving method, the multiple address overlapping display driving method has an enhanced displayed luminance. Here, the address-display separation driving method refers to a method in which, within a unit subfield, reset and address steps are performed for all Y electrode lines $Y_1$, $Y_2$, . . . $Y_{480}$, during a certain period and a display discharge step is then performed.

Referring to FIG. 4, a unit frame is divided into 8 subfields $SF_1$, $SF_2$, . . . $SF_8$ for achieving a time-division gray scale display. In each subfield, reset, address and display discharge steps are performed, and the time allocated to each subfield is determined by a display discharge time. For example, in the case of displaying a 256 step scale with 8-bit video data in the unit of frames, if a unit frame (generally 1/60 seconds) is comprised of 256 unit times, the first subfield $SF_1$, driven by the least significant bit (LSB) video data, has 1 ($2^0$) unit time, the second subfield $SF_2$2 ($2^1$) unit times, the third subfield $SF_3$4 ($2^2$) unit times, the fourth subfield $SF_4$8 ($2^3$) unit times, the fifth subfield $SF_5$16 ($2^4$) unit times, the sixth subfield $SF_6$32 ($2^5$) unit times, the seventh subfield $SF_7$64 ($2^6$) unit times, and the eighth subfield $SF_8$, driven by the most significant bit (MSB) video data, 128 ($2^6$) unit times. In other words, since the sum of unit times allocated to the respective subfields is 257 unit times, 255 steps can be displayed, 256 steps including one step which is not display-discharged at any subfield.

After the address step is performed and the display discharge step is then performed with respect to the first Y electrode line $Y_1$ or the first Y electrode line group, e.g., $Y_1$, $Y_2$, $Y_3$ and $Y_4$, in the first subfield $SF_1$, the address step is performed with respect to the first Y electrode line $Y_1$ or the first Y electrode line group, e.g., $Y_1$, $Y_2$, $Y_3$ and $Y_4$, in the second subfield $SF_2$. This procedure is applied to the subsequent subfields $SF_3$, $SF_4$, . . . $SF_8$ in the same manner. For example, the address step is performed and the display discharge step is then performed with respect to the second Y electrode line $Y_2$ or the second Y electrode line group, e.g. $Y_5$, $Y_6$, $Y_7$ and $Y_8$, in the seventh subfield $SF_7$. Then, in the eighth subfield $SF_8$, the address electrode is performed and the display discharge step is then performed with respect to the second Y electrode step line $Y_2$ or the second Y electrode line group, e.g., $Y_5$, $Y_6$, $Y_7$ and $Y_8$. The time for a unit subfield equals the time for a unit frame. The respective subfields overlap on the basis of the driven Y electrode lines $Y_1$, $Y_2$, . . . $Y_{480}$, to form a unit frame. Thus, since all subfields $SF_1$, $SF_2$, . . . $SF_8$ exist in every timing, time slots for addressing depending on the number of subfields are set between pulses for display discharging, for the purpose of performing the respective address steps.

As one of the address-display overlapping driving methods, a driving method in which the address step is performed between the pulses for display discharging in the order of subfields $SF_1$, $SF_2$, . . . $SF_8$, is generally used.

According to this driving method, after the pulses for display discharges simultaneously applied to the Y electrode lines $Y_1, Y_2, \ldots Y_{480}$ terminate, the pulses for display discharges simultaneously applied to the X electrode lines $X_1, X_2, \ldots X_n$ start. Also, the scan pulses and the corresponding display data signals are applied after the pulses for display discharges simultaneously applied to the X electrode lines $X_1, X_2, \ldots X_n$terminate and before the pulses for display discharges simultaneously applied to the Y electrode lines $Y_1, Y_2, \ldots Y_{480}$ start. Thus, since the pulses for display discharges simultaneously applied to the X electrode lines $X_1, X_2, \ldots X_n$ start at the termination of the pulses for display discharges simultaneously applied to the Y electrode lines $Y_1, Y_2, \ldots Y_{480}$, subsequent reset or addressing times can be maximally secured, thereby enhancing the resetting or addressing performance.

As described above, there is a relatively large difference between the switching time from the display discharges of the Y electrode lines $Y_1, Y_2, \ldots Y_{480}$ to the display discharges of the X electrode lines $X_1, X_2, \ldots X_n$ and the switching time from the display discharges of the X electrode lines $X_1, X_2, \ldots X_n$ to the display discharges of the Y electrode lines $Y_1, Y_2, \ldots Y_{480}$. However, conventionally, the power levels of the pulses for display discharges have been all the same. Thus, according to the conventional driving method, the display discharges of the Y electrode lines $Y_1, Y_2, \ldots Y_{480}$ have a relatively weak influence on the display discharges of the X electrode lines $X_1, X_2, \ldots X_n$. On the contrary, the display discharges of the X electrode lines $X_1, X_2, \ldots X_n$ have a relatively stronger influence on the display discharges of the Y electrode lines $Y_1, Y_2, \ldots Y_{480}$. The non-uniformity in the display discharges deteriorates the performance and efficiency of a display discharge and damages the MgO layer (12 of FIG. 1) as the protective layer, thereby shortening the lifetime of the plasma display panel (1 of FIG. 1).

SUMMARY OF THE INVENTION

To solve the above problem, it is an object of the present invention to provide a method for driving a plasma display panel which enhances the performance and efficiency of a display discharge and increase the lifetime of the driven plasma display panel.

To achieve the above object, there is provided a method for driving a plasma display panel having front and rear substrates opposed to and facing each other, X and Y electrode lines formed between the front and rear substrates to be parallel to each other and address electrode lines formed to be orthogonal to the X and Y electrode lines, to define corresponding pixels at interconnections, such that a scan pulse is applied to the respective Y electrode lines with a predetermined time difference and the corresponding display data signals are simultaneously applied to the respective address electrode lines to form wall charges at pixels to be displayed, pulses for a display discharge are alternately applied to the X and Y electrode lines to cause a display discharge at the pixels where the wall charges have been formed, the pulses for display discharges simultaneously applied to the X electrode lines start to occur after the pulses for display discharges simultaneously applied to the Y electrode lines terminate, and the scan pulses and the corresponding display data signals are applied after the pulses for display discharges simultaneously applied to the X electrode lines terminate and before the pulses for display discharges simultaneously applied to the Y electrode lines start to occur, the driving method wherein the power levels of pulses for display discharges simultaneously applied to the Y electrode lines is greater than the power levels of pulses for display discharges simultaneously applied to the X electrode lines.

Accordingly, a difference between the power levels of the pulses for display discharges can compensate for a difference between the switching time from the display discharges of the Y electrode lines to the display discharges of the X electrode lines and the switching time from the display discharges of the X electrode lines to the display discharges of the Y electrode lines. In other words, the non-uniformity in the display discharges can be prevented by relatively strengthening the effects of the display discharges of the X electrode lines on the display discharges of the Y electrode lines, thereby enhancing the performance and efficiency of a display discharge and increasing the lifetime of the driven plasma display panel.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

Figure 1:
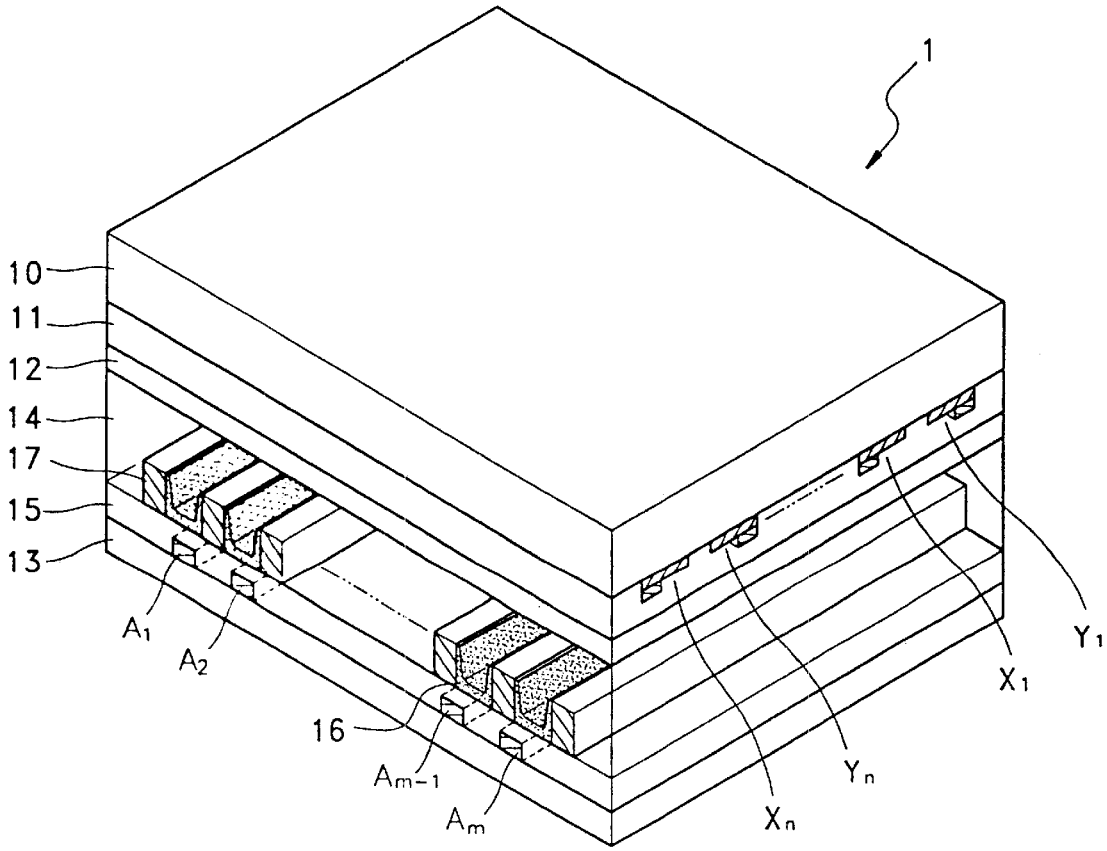
FIG. 1 PRIOR ART
FIG. 1 shows an internal perspective view illustrating the structure of a general three-electrode surface-discharge plasma display panel.
Figure 2:
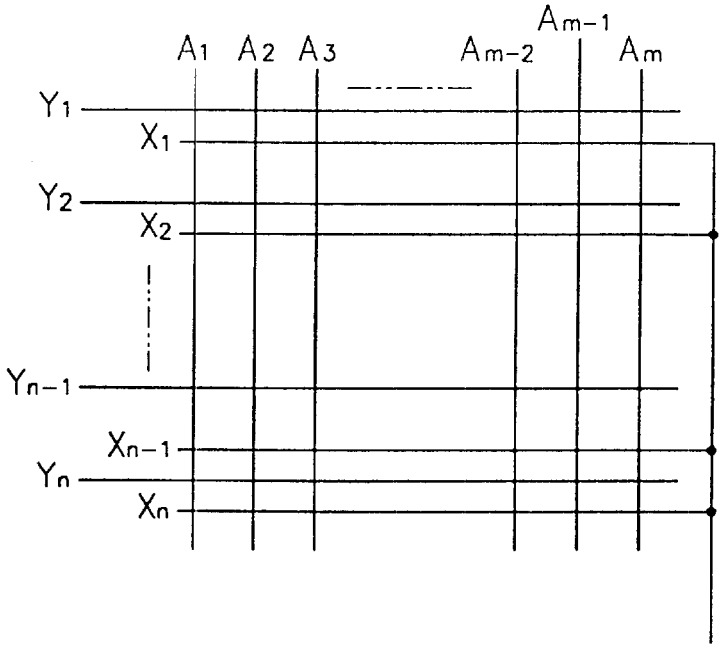
FIG. 2 PRIOR ART
FIG. 2 shows an electrode line pattern of the panel shown in FIG. 1.
Figure 3:
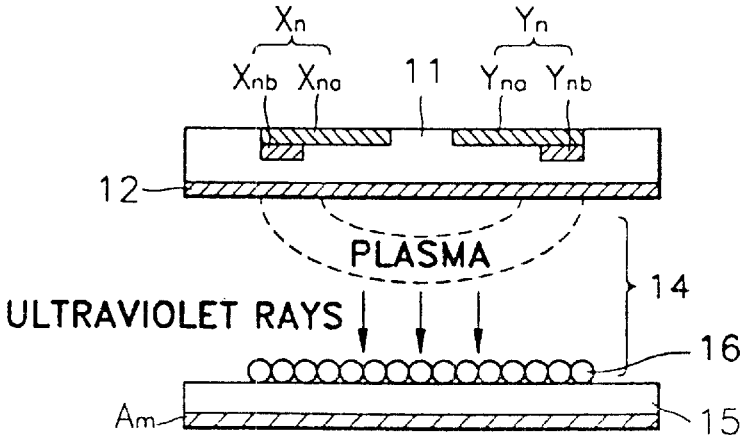
FIG. 3 PRIOR ART
FIG. 3 is a cross section of an example of a pixel of the panel shown in FIG. 1.
Figure 4:
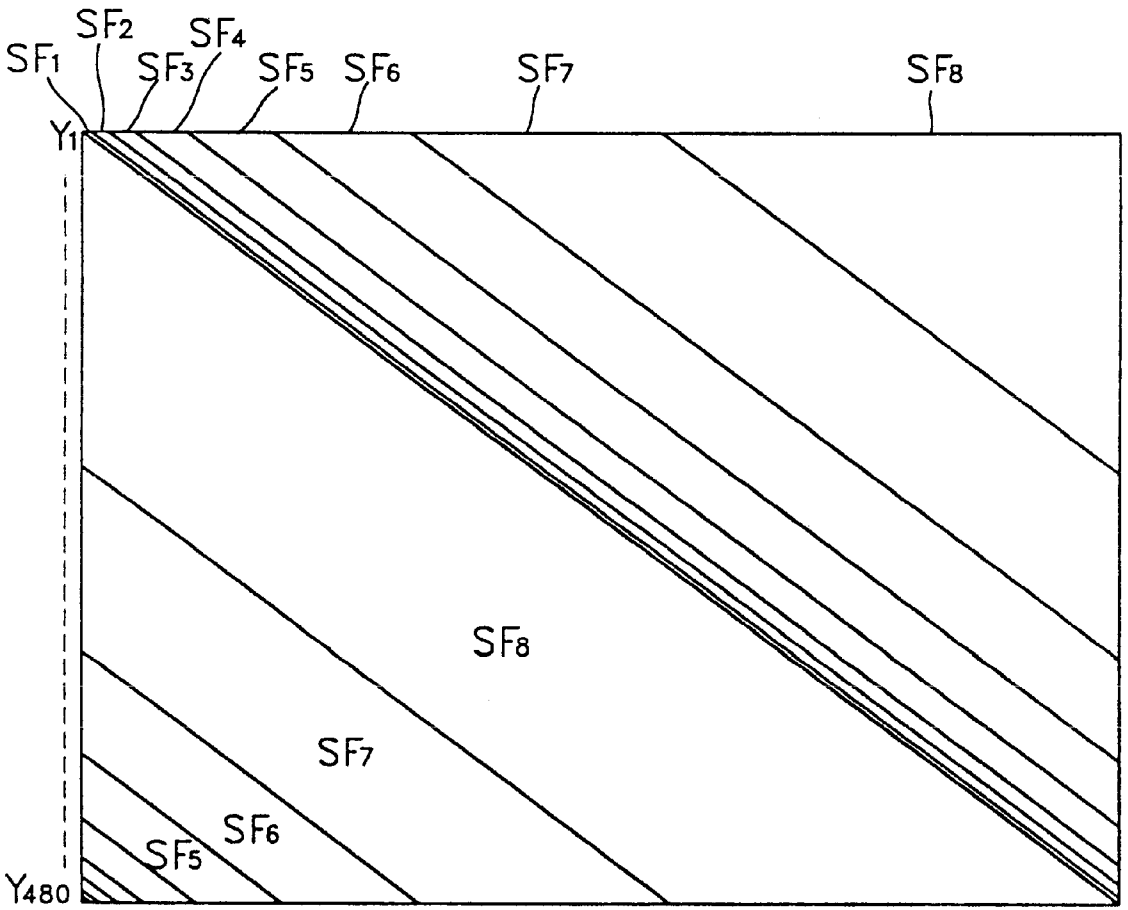
FIG. 4 PRIOR ART
FIG. 4 is a timing diagram showing the format of a unit display period based on a general method for driving a plasma display panel.
Figure 5:
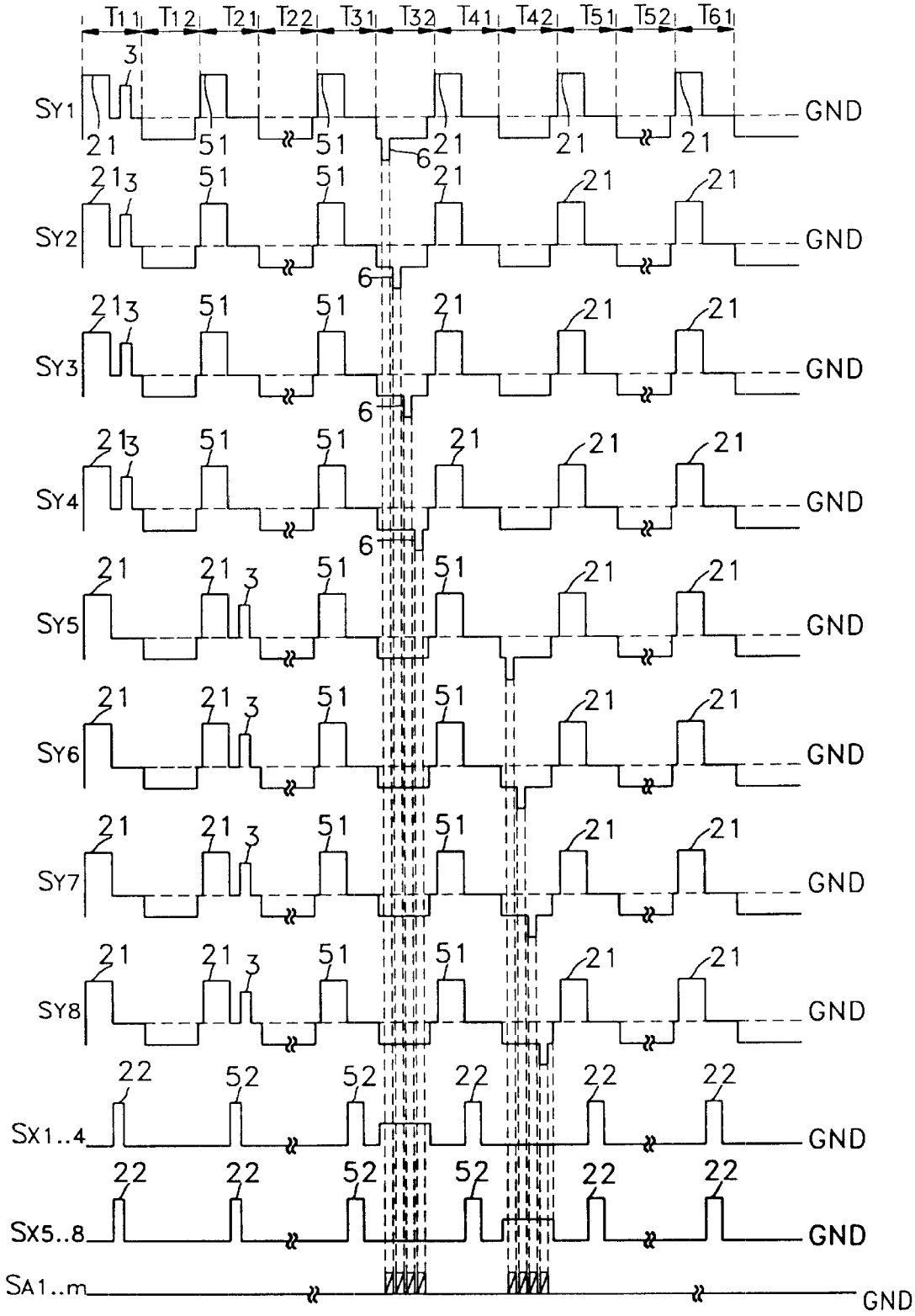
FIG. 5 is a voltage waveform diagram of driving signals in a unit display period based on a method for driving a plasma display panel according to an embodiment of the present invention.
Figure 6:
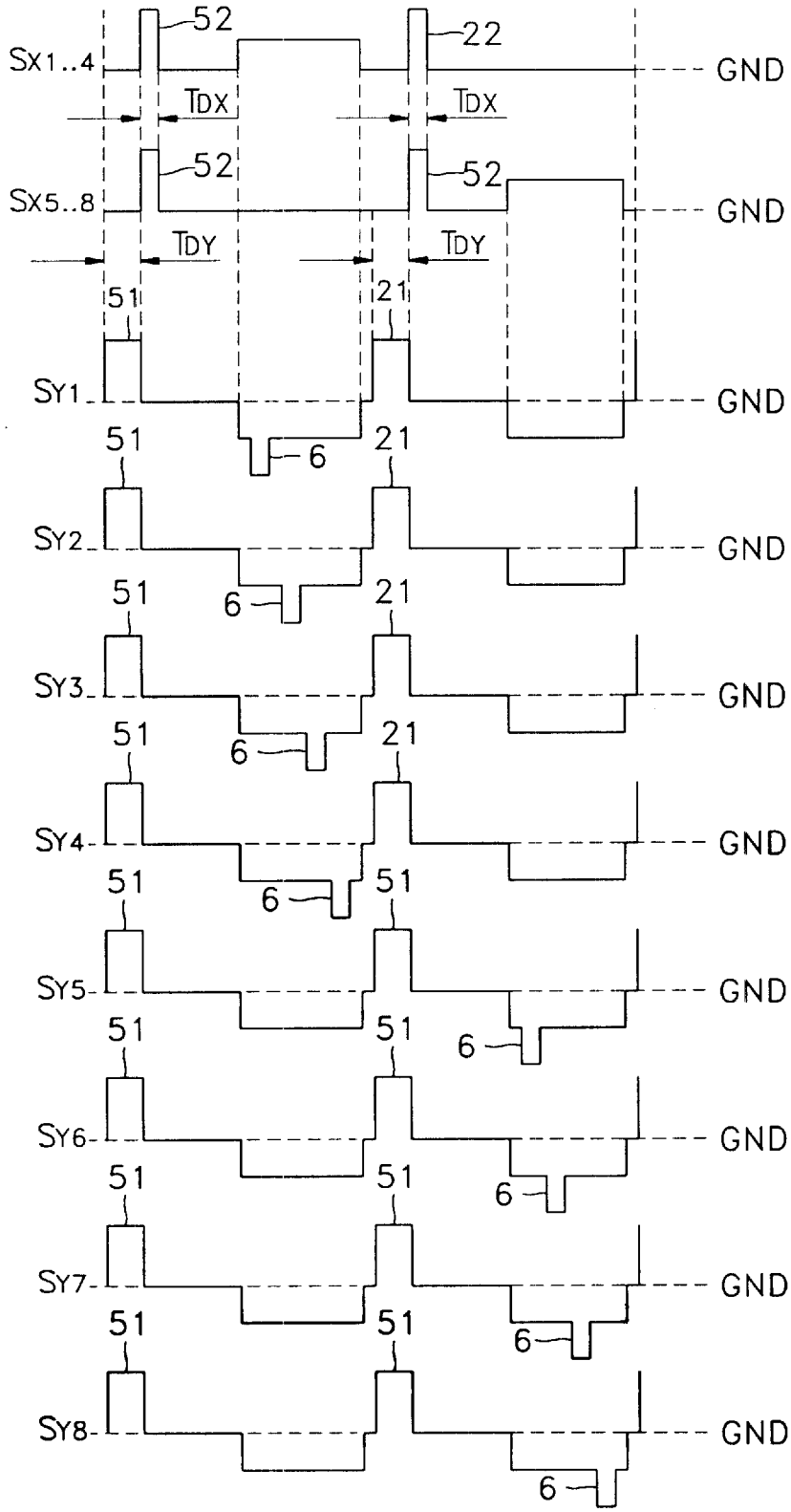
FIG. 6 is a detailed voltage waveform diagram of driving signals applied to the Y and X electrode lines corresponding to the respective subfields in periods $T_{31}$ to $T_{42}$ of FIG. 5.

FIG. 5 shows driving signals in a unit subfield based on a driving method according to the present invention. In FIG. 5, reference marks $S_{Y1}, S_{Y2}, \ldots S_{Y8}$ denote driving signals applied to the Y electrode lines corresponding to the respective subfields. In more detail, $S_{Y1}$, denotes a driving signal applied to Y electrode lines of a first subfield ($SF_1$ of FIG. 4), $S_{Y2}$ denotes a driving signal applied to Y electrode lines of a second subfield ($SF_2$ of FIG. 4), $S_{Y3}$ denotes a driving signal applied to Y electrode lines of a third subfield ($SF_3$ of FIG. 4), $S_{Y4}$ denotes a driving signal applied to Y electrode lines of a fourth subfield ($SF_4$ of FIG. 4), $S_{Y5}$ denotes a driving signal applied to Y electrode lines of a fifth subfield ($SF_5$ of FIG. 4), $S_{Y6}$ denotes a driving signal applied to Y electrode lines of a sixth subfield ($SF_6$ of FIG. 4), $S_{Y7}$ denotes a driving signal applied to Y electrode lines of a seventh subfield ($SF_7$ of FIG. 4), and $S_{Y8}$ denotes a driving signal applied to a Y electrode lines of an eighth subfield ($SF_8$ of FIG. 4), respectively. Reference marks $S_{X1 \ldots 4}$ and $S_{X5 \ldots 8}$ denote driving signals applied to the X electrode line groups corresponding to the Y electrode lines, $S_{A1 \ldots m}$ denotes display data signals applied to all address electrode lines ($A_1, A_2, \ldots A_m$ of FIG. 1), and GND denotes a ground voltage. FIG. 6 is an enlarged voltage waveform diagram of driving signals applied to the Y and X electrode lines corresponding to the respective subfields in periods $T_{31}$ to $T_{42}$ of FIG. 5.

Referring to FIGS. 5 and 6, while the scan pulse 6 is applied to the Y electrode lines corresponding to the respective subfields with a predetermined time difference, the corresponding display data signals $S_{A1 \ldots m}$ are simultaneously applied to the respective address electrode lines $A_1$, $A_2, \ldots A_m$, thereby forming wall charges at pixels where a display discharge is to occur. Subsequently, pulses 21, 51, 22 and 52 for display discharges are alternately applied to all the X and Y electrode lines to cause display discharges at pixels where the wall charges have been formed. Also, after the pulses 21 and 51 for display discharges simultaneously applied to the Y electrode lines $Y_1, Y_2, \ldots Y_{480}$ terminate, the pulses 22 and 52 for display discharges simultaneously applied to the X electrode lines $X_1, X_2, \ldots X_n$ start. Accordingly the maximum resetting or addressing time after termination of the pulses 22 and 52 for X-electrode display discharges, can be obtained, thereby enhancing the resetting or addressing performance. During an address step, the scan pulses 6 and the corresponding display data signals $S_{A1 \ldots m}$ are applied after the pulses 52 for display discharges simultaneously applied to the X electrode lines $X_1, X_2, \ldots X_n$ terminate and before the pulses 21 for display discharges simultaneously applied to the Y electrode lines $Y_1, Y_2, \ldots Y_{480}$ start.

Here, the widths $T_{DY}$ of the pulses 21 and 51 for display discharges simultaneously applied to the Y electrode lines $Y_1, Y_2, \ldots Y_{480}$ are greater than the widths $T_{DX}$ of the pulses 22 and 52 for display discharges simultaneously applied to the X electrode lines $X_1, X_2, \ldots X_n$. Accordingly, a power difference between the pulses for display discharges can compensate for a difference between the switching time from display discharges of the Y electrode lines $Y_1, Y_2, \ldots Y_{480}$ to display discharges of the X electrode lines $X_1, X_2, \ldots X_n$ and the switching time from display discharges of the X electrode lines $X_1, X_2, \ldots X_n$ to display discharges of the Y electrode lines $Y_1, Y_2, \ldots Y_{480}$. In other words, the effect of display discharges of the Y electrode lines $Y_1, Y_2, \ldots Y_{480}$ on display discharges of the X electrode lines $X_1, X_2, \ldots X_n$ is relatively strengthened, thereby preventing non-uniformity in the display discharge. Therefore, the performance and efficiency of a display discharge can be improved and the lifetime of a driven plasma display panel can be increased.

The pulses 21, 22, 51 and 52 for display discharges are consistently applied to the X electrode lines $X_1, X_2, \ldots X_n$ and all Y electrode lines $Y_1, Y_2, \ldots Y_{480}$, and a reset pulse 3 or scan pulse 6 is applied between the pulses 21, 22, 51 and 52 for display discharges. Here, resetting or addressing pulses are applied to the Y electrode lines corresponding to a plurality of subfields $SF_1, SF_2, \ldots SF_8$.

There exists a predetermined quiescent period until the scan pulse 6 is applied after the reset pulse 3 was applied, so that space charges are smoothly distributed at the corresponding pixel areas. In FIG. 5, time periods $T_{12}$, $T_{21}$, $T_{22}$ and $T_{31}$, denote quiescent periods corresponding to Y electrode line groups of the first through fourth subfields, and time periods $T_{22}$, $T_{31}$, $T_{32}$ and $T_{41}$, denote quiescent periods corresponding to Y electrode line groups of the fifth through eighth subfields. The pulses 51 and 52 for a display discharge applied during the respective quiescent periods cannot actually cause a display discharge but allow space charges to be smoothly distributed at the corresponding pixel areas. However, the pulses 21 and 22 for a display discharge applied during periods other than the quiescent periods cause a display discharge at the pixels where wall charges have been formed by the scan pulse 6 and the display data signal $S_{A1 \ldots m}$.

Between the last pulses 52, among the pulses 51 and 52 for a display discharge applied during the quiescent periods, and the first pulses 21 for a display discharge, subsequent to the last pulses 52, that is, $T_{32}$ or $T_{42}$, addressing is performed four times. For example, addressing is performed for the Y electrode line group corresponding to the first through fourth subfields during a time period $T_{32}$. Also, addressing is performed for the Y electrode line group corresponding to the fifth through eighth subfields during a time period $T_{42}$. As described above with reference to FIG. 4, since all subfields $SF_1, SF_2, \ldots SF_8$ exist at every timing, time slots for addressing, depending on the number of subfields are set between the respective pulses for a display discharge for the purpose of performing the respective address steps.

Figure 7:
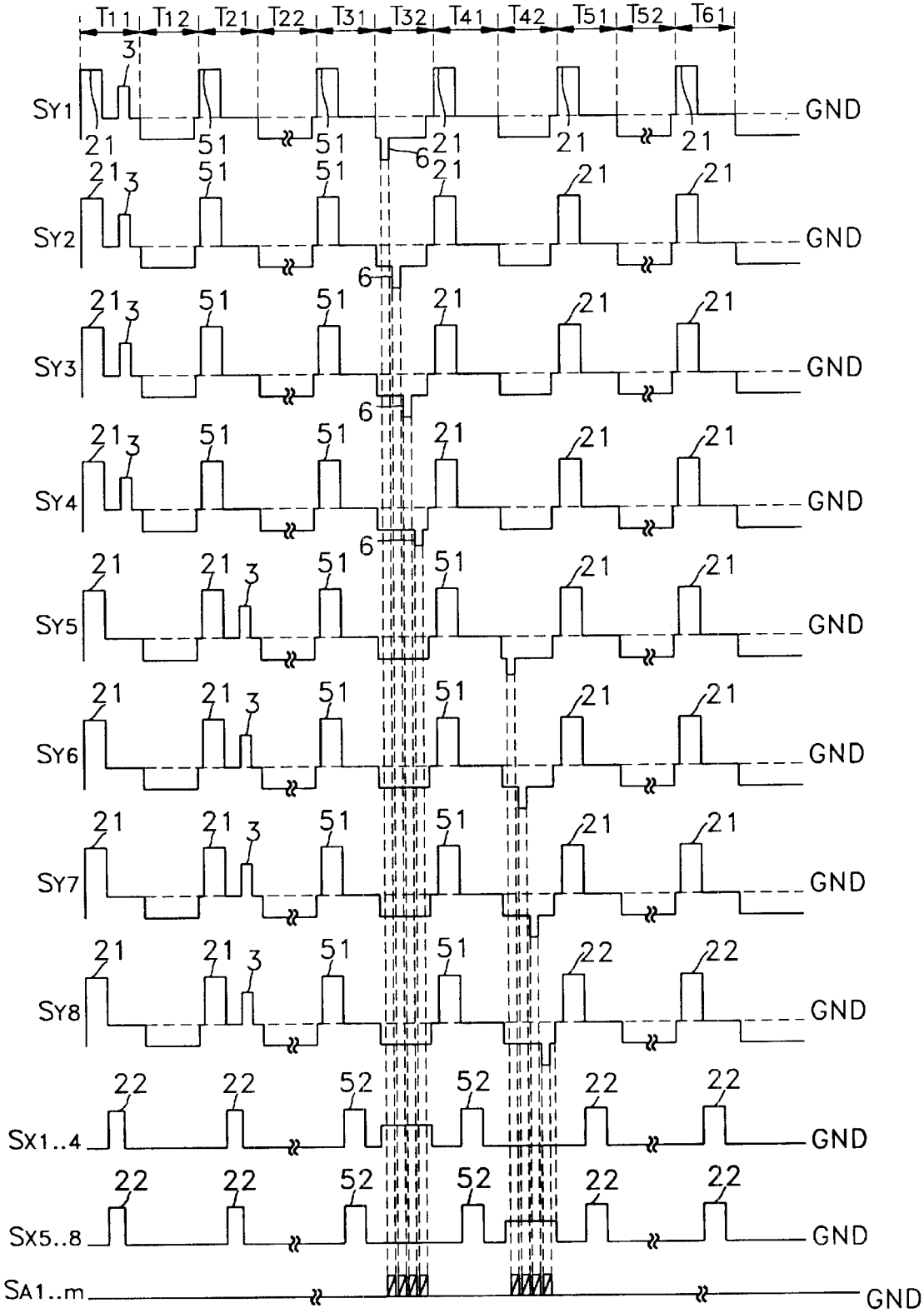
FIG. 7 is a voltage waveform diagram of driving signals in a unit display period based on a method for driving a plasma display panel according to another embodiment of the present invention.
Figure 8:
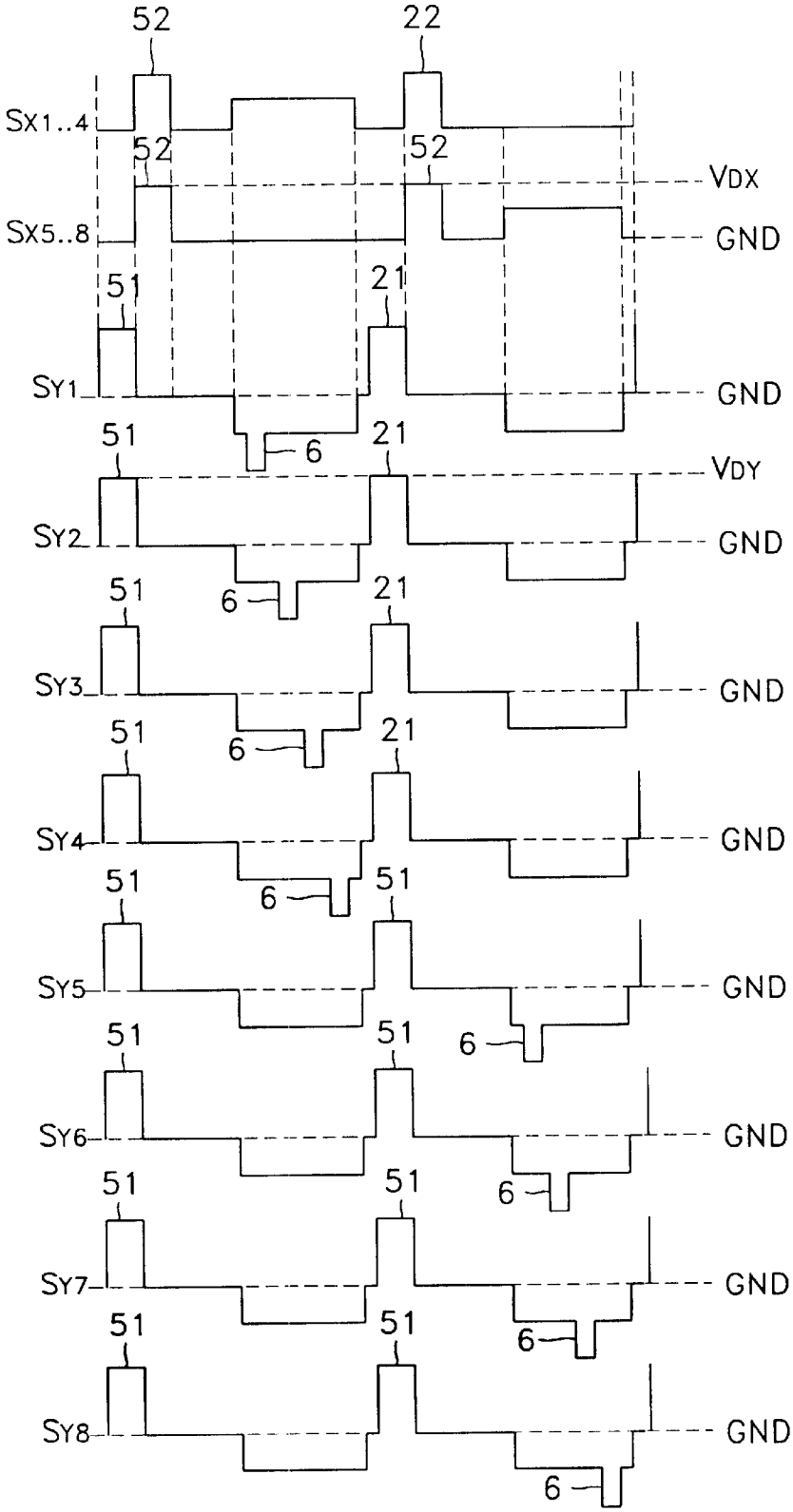
FIG. 8 is a detailed voltage waveform diagram of driving signals applied to the Y and X electrode lines corresponding to the respective subfields in periods $T_{31}$ to $T_{42}$ of FIG. 7.

FIG. 7 shows driving signals in a unit display period based on a method for driving a plasma display panel according to another embodiment of the present invention, and FIG. 8 shows driving signals applied to the Y and X electrode lines corresponding to the respective subfields in periods $T_{31}$ to $T_{42}$ of FIG. 7. In FIGS. 5, 6, 7 and 8, the same reference numerals denote the same functional elements. In FIG. 8, reference mark $V_{DY}$ denotes voltages of pulses 21 and 51 for Y-electrode display discharges, and reference mark $V_{DX}$ denotes voltages of pulses 22 and 52 for X-electrode display discharges.

Now, only differences between FIGS. 5 and 6 and FIGS. 7 and 8 will be described.

The voltages $V_{DY}$ of pulses 21 and 51 for Y-electrode display discharges are greater than the voltages $V_{DX}$ of pulses 22 and 52 for X-electrode display discharges. Accordingly, a power difference between the pulses for display discharges can compensate for a difference between the switching time from display discharges of the Y electrode lines $Y_1, Y_2, \ldots Y_{480}$ to display discharges of the X electrode lines $X_1, X_2, \ldots X_n$ and the switching time from display discharges of the X electrode lines $X_1, X_2, \ldots X_n$ to display discharges of the Y electrode lines $Y_1, Y_2, \ldots Y_{480}$. In other words, the effect of display discharges of the Y electrode lines $Y_1, Y_2, \ldots Y_{480}$ on display discharges of the X electrode lines $X_1, X_2, \ldots X_n$ is relatively strengthened, thereby preventing non-uniformity in the display discharge. Therefore, the performance and efficiency of a display discharge can be improved and the lifetime of a driven plasma display panel can be increased.

As described above, in the method for driving a plasma display panel according to the present invention, a difference between the switching time from display discharges of the Y electrode lines to display discharges of the X electrode lines and the switching time from display discharges of the X electrode lines to display discharges of the Y electrode lines is compensated for by a power difference between pulses for display discharges. In other words, the effect of display discharges of the Y electrode lines on display discharges of the X electrode lines is relatively strengthened, thereby preventing non-uniformity in the display discharge.

Therefore, the performance and efficiency of a display discharge can be improved and the lifetime of a driven plasma display panel can be increased.

Although the invention has been described with respect to a preferred embodiment, it is not to be so limited as changes and modifications can be made which are within the full intended scope of the invention as defined by the appended claims.

What is claimed is:

1. A method for driving a plasma display panel having front and rear substrates opposed to and facing each other, X and Y electrode lines between the front and rear substrates, parallel to each other, and address electrode lines orthogonal to the X and Y electrode lines, to define corresponding pixels at intersections, the method comprising:

alternately and successively applying pulses for display discharges to the X and Y electrode lines to cause display discharges at pixels where wall charges have been formed, wherein power levels of pulses for display discharges simultaneously applied to the Y electrode lines are greater than power levels of the pulses for display discharges simultaneously applied to the X electrode lines; and applying scan pulses to only some of the Y electrode lines and simultaneously applying the corresponding display data signals to respective address electrode lines, after the pulses for display discharges simultaneously applied to the X electrode lines terminate and before the successively applied pulses for display discharges simultaneously applied to the Y electrode lines start, thereby forming wall charges where the display discharges are to occur.

2. The method according to claim 1, wherein pulses for display discharges simultaneously applied to the Y electrode lines are wider than pulses for display discharges simultaneously applied to the X electrode lines.

3. The method according to claim 1, wherein pulses for display discharges simultaneously applied to the Y electrode lines have voltages higher than pulses for display discharges simultaneously applied to the X electrode lines.

* * * * *